US005631436A

United States Patent [19]

Brown et al.

[11] Patent Number: 5,631,436

[45] Date of Patent: May 20, 1997

[54] GUN EQUIPPED WITH DOWN-BORE LIQUID PROPELLANT BOOSTER STAGE TO INCREASE PROJECTILE MUZZLE VELOCITY

[75] Inventors: Steven J. Brown, Pittsfield, Mass.; Robert A. Pate, Logan, Utah

[73] Assignee: Martin Marietta Corporation, Bethesda, Md.

[21] Appl. No.: 491,052

[22] Filed: Jun. 15, 1995

[51] Int. Cl.[6] ..... F41F 1/00

[52] U.S. Cl. ..... 89/8; 89/7

[58] Field of Search ..... 89/8, 7

[56] References Cited

U.S. PATENT DOCUMENTS 4,336,741 6/1982 Baines ..... 89/7

4,590,842 5/1986 Goldstein ..... 89/8

5,233,903 8/1993 Saphier et al. ..... 89/8

*Primary Examiner*—J. Woodrow Eldred

*Attorney, Agent, or Firm*—Robert A. Cahill; Geoffrey H. Krauss

[57] ABSTRACT

A booster stage is positioned down-bore from the breech of a gun to contain a charge of liquid propellant that is ignited by the combustion gases of a detonated breech propellant charge trailing the projectile down the gun bore. The detonated liquid propellant increases the bore gas pressure and thus accelerates the projectile to a higher muzzle velocity.

14 Claims, 2 Drawing Sheets

GUN EQUIPPED WITH DOWN-BORE LIQUID PROPELLANT BOOSTER STAGE TO INCREASE PROJECTILE MUZZLE VELOCITY

FIELD OF THE INVENTION

The present invention relates to armaments and particularly to guns for firing high velocity, armor-piercing projectiles.

BACKGROUND OF THE INVENTION

In a conventional gun, acceleration of a projectile to muzzle velocity is achieved solely by combustion of a propellant charge detonated in the gun breech. Traditionally the breech propellant charge has been in a solid form. Considering the advanced protective armor carried by state-of-the-art military tanks, tank guns, to be effective against such tanks, must generate muzzle energies in the range of 12–14 Mega-Joules to accelerate, for example, a 120 mm projectile weighing 7.12 Kg. to a muzzle velocity of 2000 m/sec. This is a tall order for existing gun steel and solid propellant technologies.

Emerging liquid propellant technology offers great promise for increasing muzzle energies and velocity for enhanced armor-piercing capabilities. One approach to boosting muzzle velocity is to equip the projectile with a travelling liquid propellant charge that is detonated as the projectile is propelled down the gun bore by a primary or main propellant charge detonated in the breech of the gun. The down-bore combustion of the travelling charge introduces increasing gas pressures in the bore aft the projectile as the pressurized gases generated by the combusting breech propellant charge are expanding and losing intensity. Muzzle velocities approaching 3000 m/sec. have been achieved using this liquid propellant travelling charge approach exemplified in Bulman, U.S. Pat. No. 4,993,309, for example.

The travelling charge approach, although effective in boosting the muzzle velocity, presents significant challenges that have yet to be overcome. Lack of repeatability and burst fire accuracy are persistent problems, since it is difficult to consistently achieve detonation of the travelling charge at a precise down-bore location on a shot-to-shot basis. The weight of the travelling charge adds to the mass that is to be accelerated down the bore, and thus the contribution of the breech charge to the projectile muzzle velocity is diminished. In addition, when using a travelling charge, a special separator is required to isolate the travelling charge from the breech charge when the latter is detonated to launch the projectile down-bore. Moreover, the presence of the travelling charge complicates loading of the projectile into the breech and ramming it into the forcing cone of the gun barrel.

SUMMARY OF THE INVENTION

It is an objective of the present invention to provide a gun that is capable of achieving increased muzzle velocities, while avoiding the challenges and drawbacks of the travelling charge approach to boosting muzzle velocity. This objective is achieved in an efficient and reliable manner in accordance with the present invention by providing a gun having a secondary propellant booster stage at an appropriate location down-bore from the breech into which a projectile and a primary propellant charge are loaded. This secondary propellant booster stage includes a cannister mounted to the gun barrel to define a reservoir in fluid communication with the bore of the gun barrel. A supply of liquid propellant is connected to introduce the liquid propellant into the reservoir for detonation by the combustion gases of the detonated primary propellant charge trailing the projectile down the bore. Combustion of the liquid propellant increases the gas pressure in the bore immediately aft the projectile, boosting the projectile to higher muzzle velocities.

The invention accordingly comprises the features of construction, combinations of elements and arrangements of parts, which will be exemplified in the constructions hereinafter set forth, and the scope of the invention will be indicated in the claims.

BRIEF DESCRIPTION OF THE DRAWINGS

For a full understanding of the nature and objects of the present invention, reference may be had to the following detailed description taken in conjunction with the accompanying drawings, in which.

DETAILED DESCRIPTION OF THE PREFERRED EMBODIMENT

Figure 1:
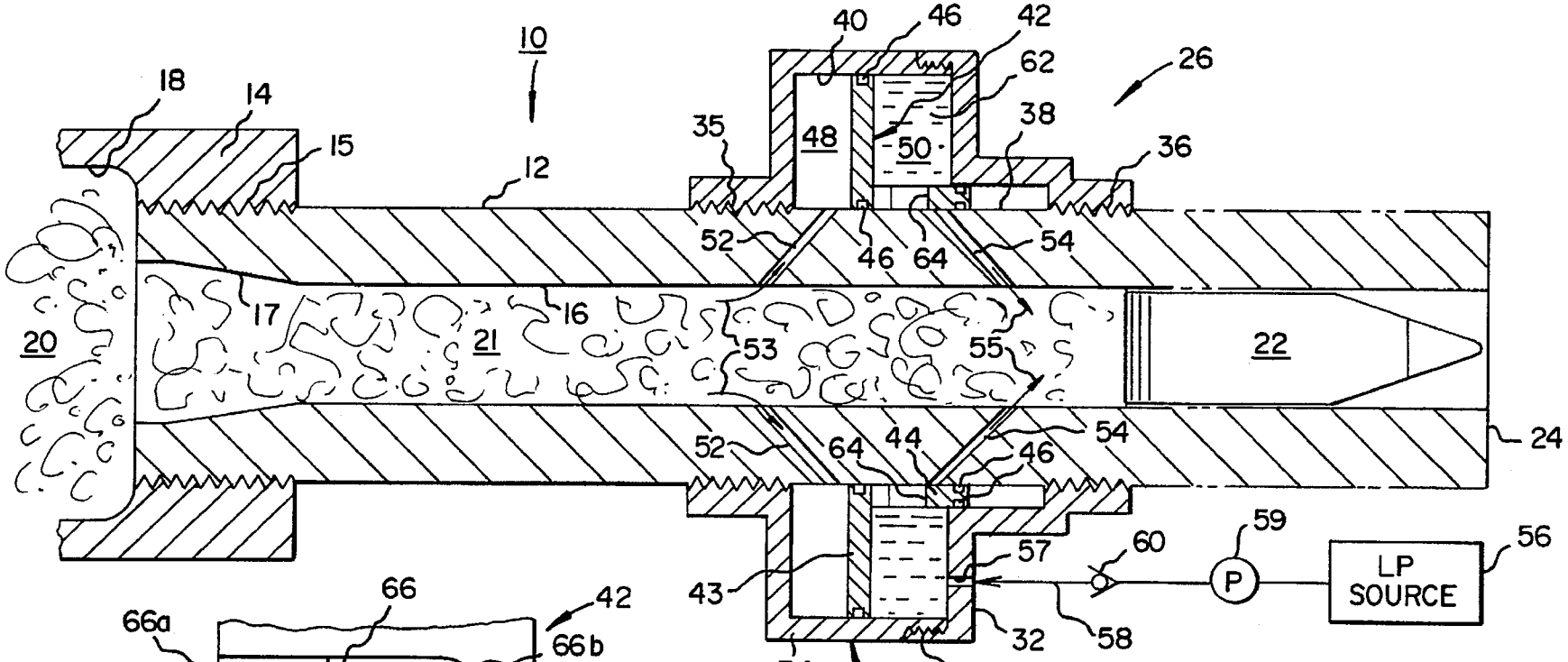
FIG. 1 is a longitudinal sectional view of a gun incorporating a down-bore secondary charge booster stage structured in accordance with one preferred embodiment of the present invention.

In accordance with the invention, a gun includes an elongated barrel joined to a breech. As embodied herein, and as seen in FIG. 1, a gun, generally indicated at 10, includes an elongated barrel 12 joined to a breech 14 by screw threads 15.

A bore 16 of barrel 12 terminates at its breech end in a forcing cone 17 opening into a breech chamber 18 in which a primary or main charge 20, hereinafter breech charge, is loaded and then detonated to generate high pressure combustion gases 21 launching a projectile 22 down the bore and out the muzzle 24 of barrel 12.

In accordance with the present invention, to increase the muzzle velocity of the gun beyond that achieved by the breech charge, which may either be in liquid or solid propellant form, a booster stage is adapted to the gun barrel. As embodied herein and as seen in FIG. 1, a secondary propellant charge booster stage, generally indicated at 26, is installed to the gun barrel 12 at a down-bore location effective to accelerate projectile 22 to a higher muzzle velocity. Booster stage 26 is comprised of a cannister, generally indicated at 30, that includes fore and aft annular casing halves 32 and 34 joined together by a threaded joint 33. The aft casing half 34 is assembled on barrel by screw threads 35, while the fore casing half 32 is assembled on the barrel via screw threads 36.

The cannister, in conjunction with a section 38 of the exterior barrel surface between thread joints 35 and 36, defines an annular chamber 40 in which an annular piston 42 is slidingly received. Piston 42 is of an L-shaped cross-section having a radial head 43 integral with an axial sleeve 44. The peripheral edge surface of piston head 43 slides against the inner cylindrical surface of aft casing half 34, and the inner cylindrical surface of piston sleeve 44 slides on the barrel peripheral surface section 38. Annular seals 46 in grooves machined in the piston head and sleeve seal the piston-cannister and piston-barrel interfaces against fluid leakage.

Piston head 43 divides cannister chamber 40 into an actuating cavity 48, aft of piston head 43, and a reservoir 50 forward of the piston head. A plurality of equiangularly spaced passages 52 are drilled through the barrel wall between bore 16 and actuating cavity 48, and a plurality of equiangularly spaced passages 54 are drilled through the barrel wall between reservoir 50 and bore 16. Passages 52 are sloped in the down-bore direction from the bore to the actuating cavity, while passages 54 are sloped in the down-bore direction from reservoir 50 back to the bore. Preferably, at least four passages 52 and at least four passages 54 are utilized in the preferred embodiment of the invention illustrated in FIG. 1.

A source 56 of liquid propellant is connected in fluid communication with reservoir 50 through port 57 in casing half 32 and a high-pressure line 58 via a pump 59 and a check valve 60. When reservoir 50 is to be charged with liquid propellant, pump 59 is driven to pump the liquid propellant from source 56 into the reservoir with sufficient pressure to force piston 42 in the aft direction to a charged position that expands the reservoir volume to accept a full charge of liquid propellant 62. As described below in conjunction with FIG. 2, during charging of the booster reservoir 50 pending the firing of gun 10, the open outer ends of passages 54 are closed off by piston sleeve 44, and thus the liquid propellant is confined in the reservoir during charging and pending the firing of gun 10.

Upon detonation of the breech charge 20, projectile 22 is accelerated down the bore followed by the high-pressure gases 21 generated by the combusting breech charge. A small percentage of the combustion gases are diverted into actuating cavity 48 through passages 52, as indicated by arrows 53. The actuating cavity is pressurized, driving piston 42 in the down-bore direction. After an incremental movement of the piston, axially elongated slots 64 in piston sleeve 44, initially respectively axially aligned aft of the reservoir open ends of passages 54, unblock these passages, and liquid propellant is expelled from reservoir 50 through slots 64 and passages 54 into bore 16 (arrows 55), where the liquid propellant is detonated by the hot breech charge combustion gases aft of projectile 22. The resulting combustion gases generated by the burning liquid propellant 62 increases the gas pressure in bore 16, thereby boosting the projectile to a higher muzzle velocity.

Figure 2:
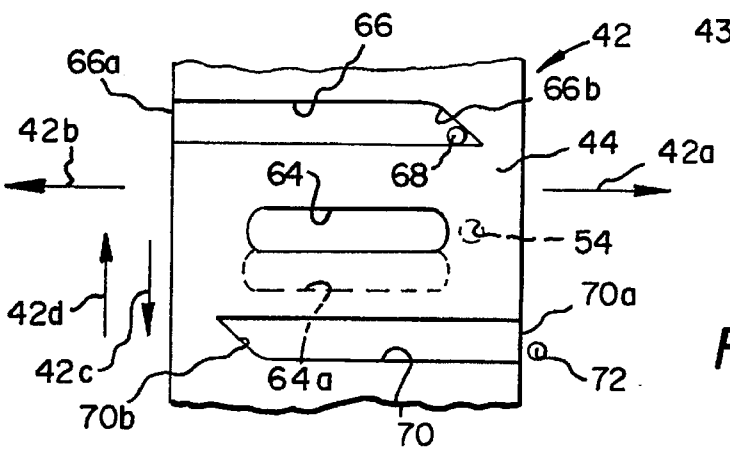
FIG. 2 is a layout view of a fragmentary section of the inner cylindrical surface of a booster piston in the boost stage of FIG. 1, illustrating the action of the booster piston during the discharging and charging the secondary charge booster stage.

As described above, the fluid pressure of the liquid propellant 62 pumped into reservoir 50 by pump 56 to recharge booster stage 26 is utilized to return piston 42 up-bore to a changed position after a gun firing to prepare the booster stage for the next gun firing. However, to achieve this resetting action, the open outer ends of passages 54 must be reclosed. Turning to FIG. 2, the inner cylindrical surface of piston sleeve 44, as embodied herein, is machined to provide a first groove 66 axially extending from an open end **66*a* in the down-bore direction to a termination in the form of a cam surface 66*b*. Operating in this groove is a pin 68 upstanding from peripheral surface section 38 of barrel 12. A second groove 70, machined in the inner sleeve surface, extends axially in the up-bore direction from an open end 70*a* to a termination in the form of a cam surface 70*b*. A second pin 72, upstanding from the barrel peripheral surface section 38, operates in this groove 70. FIG. 2 representively illustrates the physical relationships of these elements with piston 42 in a charged position preparatory to a gun firing. As such, slots 64 are respectively positioned in axially aligned, aft relationships with the open ends of passages 54. Pin 68 is in engagement with cam surface 66*b* of groove 66, and pin 72 is removed from groove 70, residing just down-bore from groove open end 70*a***.

When piston 42 is propelled from its charged position in the down-bore direction (arrow **42*a*) by the breech charge high-pressure gases entering actuating cavity 48 through passages 52, pin 72 enters the open end 70*a* of groove 70, as slots 64 unblock the outer (reservoir) ends of passages 52. Liquid propellant 62 is expelled from reservoir 50 through passages 54 for ignition in bore 16, as described above. At the conclusion of the down-bore stroke of the piston 42, pin 68 exits groove 66 through its open end 66*a* as pin 72 encounters cam surface 70*b* at the closed end of groove 70. Piston 42 is thus cammed through a rotational increment in the direction of arrow 42*c* to a discharged position, wherein slots 64 are shifted angularly to positions, indicated in phantom at 64*a*, that are no longer axially aligned with the outer open ends of passages 54. Thus these passages are now closed off to permit charging of booster stage 26 as piston 42 is driven aftward (arrow 42*b*) by the fluid pressure of the liquid propellant 62 being pumped into reservoir 50. When piston 42 approaches its charged position, pin 76 exits groove 70 through its open end 70*a*. Concurrently, pin 68 acts against cam surface 66*b* of groove 66, camming piston 42 through a rotational increment in the direction of arrow 42*d*, restoring piston 42 to its charged position with slots 42 in solid line positions, representatively illustrated in FIG. 2**, ready for the next fun firing.

Taking, for example, a typical high velocity 120 mm projectile weighing 7.12 Kg and assuming a charge to mass ratio of 1:1, the requisite breech propellant charge in liquid form would be approximately 5 liters. If a 30% booster propellant charge (1.5 liters) is added to reservoir 50 and ignited down-bore at a point 40% of the bore length and fully combusted at 80% of the bore length, projectile muzzle velocity should readily exceed 2,000 m/sec. If the bore length is 4.7 meters, for example, the bore-opening ends of passage 54 should be located 1.88 meters down-bore from the breech to achieve booster propellent ignition at the 40% bore-length mark. The booster propellant charge would then be fully consumed at 3.76 meters, the 80% bore-length mark. To accommodate the significantly increased down-bore pressures, it is estimated that the weight of gun barrel 12 would have to be increased approximately 47%.

If the annular geometry of booster reservoir 50 is, for example, 12.09 inches outer diameter, 10 inches inner diameter, and 2.5 inches axial length, the natural resonant frequency of the reservoir charged with 1.5 liters would be on the order of 3,900 Hertz with a period of 0.26 ms. If the distance between the bore opening ends of passages 52 is at least 6 inches up-bore from the bore opening ends of passages 54, the time constant of piston 42 is such that it should react to inject liquid propellant into the bore 16 in properly timed relation with the travel of projectile 22 down the bore 16. The diameters of the booster propellant injection passages 54 should be 0.5 inches in order to achieve reasonable liquid propellant injection flow rates into the gun bore. The requisite power to pump the booster propellant charge into the bore 16 is expected to be approximately 5% of the total energy in the breech charge 20.

Figure 3:
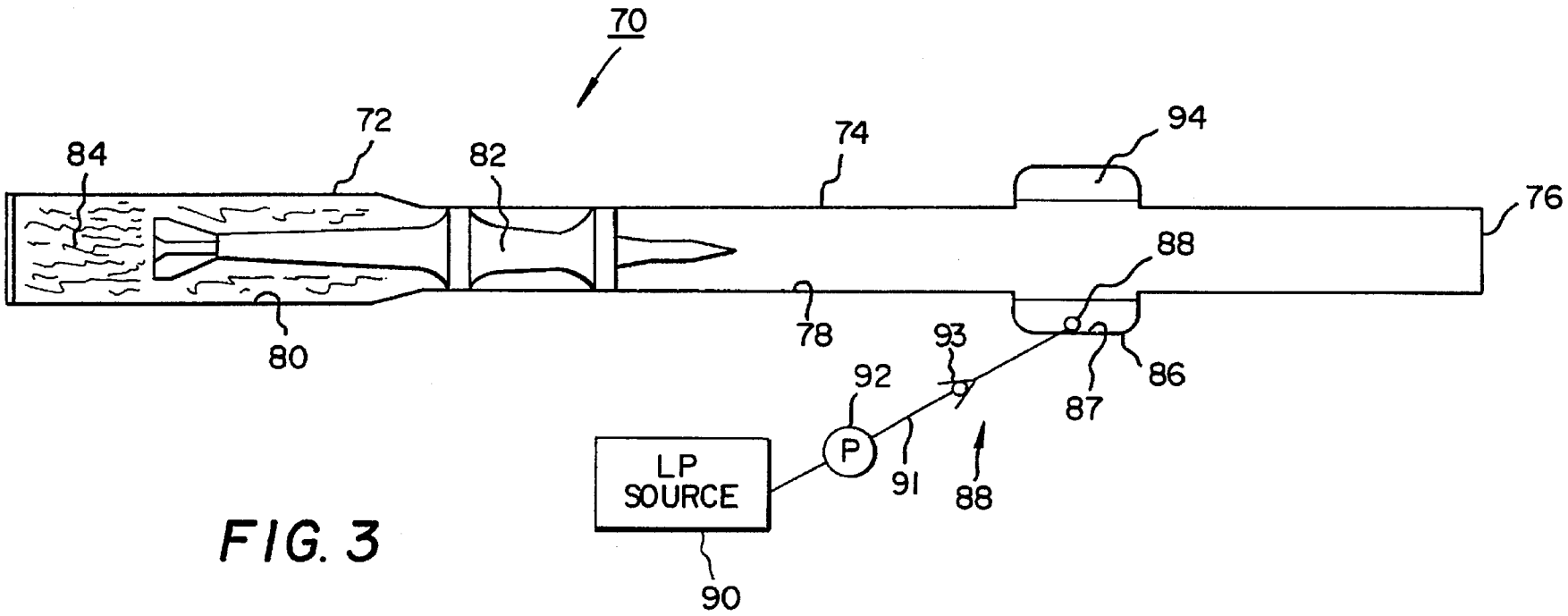
FIG. 3 is a simplified longitudinal sectional view of a gun incorporating a down-bore secondary charge booster stage structured in accordance with an alternative preferred embodiment of the present invention. Like reference numerals referred to corresponding parts throughout the several views of the drawings.

In the embodiment of the invention seen in FIG. 3, a gun, generally indicated at 70, includes a breech 72 and a barrel 74 terminating at a muzzle 76. The barrel bore 78 communicates with a breech chamber 80 in which is loaded a projectile 82 and a breech charge 84 in either liquid or solid propellant form. At an appropriate down-bore location, a section of bore 78 is radially expanded to provide an annular canister 86 of a secondary charge booster stage, generally indicated at 88. Positioned in tangential relation to the inner cylindrical surface 87 of canister 86 is a nozzle 88 connected in fluid communication with a liquid propellant source 90 via a fluid line 91, a pump 92, and a check valve 93.

Liquid propellant is pumped into canister 86 through nozzle 88 with sufficient velocity, such that its angular momentum and accompanying centrifugal forces create an annular reservoir 94 of liquid propellant flowing in a toroidal path hugging the peripheral surface 87 in surrounding relation to barrel bore 78. U.S. Pat. No. 5,016,517, the disclosure of which is incorporated herein, describes in greater detail the utilization of this tangential charging approach to the creation toroidal flow of a breech liquid propellant charge in a liquid propellant gun.

As the projectile travels past secondary charge booster stage 88 under the propulsion of the detonated breech charge 84, the trailing combustion gases ignite the liquid propellant flowing in reservoir 94 to increase the bore gas pressure aft of the projectile 82 and thus boost the projectile to a higher muzzle velocity. It will be appreciated that the magnitude of this acceleration boost can be readily adjusted by controlling the volume of liquid pumped into the reservoir 94. The combustion rate of the secondary liquid propellant charge is largely determined by the bore length-to-diameter ratio of the reservoir 94, and thus provisions may be made to adjust this ratio. It will also be appreciated that additional charge booster stages 88 may be provided at appropriately distributed down-bore locations to provide multiple acceleration boosts to projectile 82.

It is thus seen that the objectives set forth above, including those made apparent from the preceding description, are efficiently attained, and, since certain changes may be made in the disclosed embodiments without departing from the scope of the invention, it is intended that all matters contained in the above description and shown in the accompanying drawings shall be interpreted as illustrative and not in a limiting sense.

What is claimed:

1. A gun comprising, in combination:

a breech for receiving a projectile and a breech propellant charge;

an elongated gun barrel having a bore communicating at one end with the breech and terminating at a muzzle; and a booster stage including:

a cannister equipped to the gun barrel down-bore from the breech to define a reservoir in fluid communication with the bore, said cannister including a cylindrical surface radially expanded from the bore to define an annular reservoir open to the bore; and charging apparatus connected to a source of liquid propellant to introduce the liquid propellant into the reservoir tangentially to the cylindrical surface Such as to produce a toroidal flow of liquid propellant surrounding the bore for charging the reservoir with the liquid propellant for detonation by combustion gases generated by detonation of the breech propellant charge that propels the projectile down the bore.

2. The gun defined in claim 1, wherein the cannister further defines a cylindrical chamber, and the booster stage further includes:

a piston slidingly received in the chamber to divide the chamber into an actuating cavity at a breech side of the piston and the annular reservoir at a muzzle side of the piston;

a first radial fluid passage in the gun barrel for diverting a portion of the breech propellant charge combustion gases from the bore into the actuating cavity to exert a pumping force on the piston; and a second radial fluid passage down-bore from the first radial passage for directing liquid propellant pumped from the reservoir by the piston into the bore for detonation aft of the projectile.

3. The gun defined in claim 2, wherein the second radial fluid passage includes a bore open end located at a point spaced from the breech by a distance approximately equal to 40% of a length of the bore.

4. The gun defined in claim 3, wherein the first radial fluid passage includes a bore open end located approximately six inches up-bore from the second radial fluid passage bore open end.

5. The gun defined in claim 2, wherein the first radial fluid passage extends from the bore to the actuating cavity in a down-bore sloped direction, and the second radial fluid passage extends from the reservoir to the bore in a down-bore sloped direction.

6. The gun defined in claim 2, wherein the piston includes a sleeve slidingly received on an exterior cylindrical surface of the barrel in normally blocking relation with a reservoir open end of the second radial fluid passage, the sleeve including a slot positioned to unblock the reservoir open end of the second radial fluid passage during down-bore axial movement of the piston to pump liquid propellant from the reservoir into the bore.

7. The gun defined in claim 6, wherein the piston is slideable along a discharge path motivated by the pumping force of the breech propellant charge combustion gases from a charged position to a discharged position while the slot is axial aligned with the reservoir open end of the second radial fluid passage and along an charge path motivated by fluid pressure of the liquid propellant charging the reservoir from the discharged position to the charged position, the charge path being angularly displaced from the discharge path such that the piston sleeve blocks the reservoir open end of the second radial fluid passage during liquid propellant charging of the reservoir, the booster stage further including camming elements interacting to angularly reposition the piston between the charge and discharge paths.

8. The gun defined in claim 7, wherein the camming elements include:

first and second pins mounted by the barrel, and first and second grooves formed in the sleeve, the first and second grooves extending in opposite axial directions from respective open ends to respective terminating cam surfaces, the first pin entering the open end of the first groove during initial piston movement along the discharge path from the charged position and engaging the cam surface of the first groove to angularly position the piston to the discharged position, the second pin entering the open end of the second groove during initial piston movement along the charge path from the discharge position and engaging the cam surface of the second groove to angularly position the piston to the charged position.

9. A method of boosting the muzzle velocity of a gun including a breech and a barrel having a bore extending from the breech to a muzzle, the method comprising the steps of:

loading a projectile and a breech propellant charge into the breech of the gun;

charging a down-bore booster stage with liquid propellant to produce a toroidal flow of liquid propellant in an annular reservoir surrounding the bore;

detonating the breech propellant charge to generate high pressure combustion gases propelling the projectile down the bore;

exposing the liquid propellant to the breech propellant charge combustion gases at a down-bore location of diminishing combustion gas pressure in the bore; and igniting the exposed liquid propellant, using the breech propellant charge combustion gases, to generate secondary combustion gases to boost combustion gas pressure in the bore and increase the projectile muzzle velocity of the gun.

10. The method defined in claim 9, wherein the exposing step includes utilizing the combustion gas pressure in the bore generated by the detonated breech propellant charge to inject the liquid propellant into the bore for detonation by the igniting step.

11. The method defined in claim 10, wherein the liquid propellant is injected into the bore at a down-bore location spaced from the breech by a distance approximately equal to 40% of the bore length.

12. A gun comprising, in combination:

a breech for receiving a projectile and a breech propellant charge;

an elongated gun barrel having a bore communicating at one end with the breech and terminating at a muzzle; and a booster stage including:

a cannister equipped to the gun barrel down-bore from the breech to define a cylindrical-chambered reservoir in fluid communication with the bore;

charging apparatus connectable to a source of liquid propellant for charging the reservoir with the liquid propellant for detonation by combustion gases generated by detonation of the breech propellant charge that propels the projectile down the bore;

a piston slidingly received in the chamber to divide the chamber into an actuating cavity at a breech side of the piston and the reservoir at a muzzle side of the piston;

a first radial fluid passage in the gun barrel for diverting a portion of the breech propellant charge combustion gases from the bore into the actuating cavity to exert a pumping force on the piston; and a second radial fluid passage down-bore from the first radial passage for directing liquid propellant pumped from the reservoir by the piston into the bore for detonation aft of the projectile, said piston including a sleeve slidingly received on an exterior cylindrical surface of the barrel in normally blocking relation with a reservoir open end of the second radial fluid passage, the sleeve including a slot positioned to unblock the reservoir open end of the second radial fluid passage during down-bore axial movement of the piston to pump liquid propellant from the reservoir into the bore.

13. The gun defined in claim 12, wherein the piston is slideable along a discharge path motivated by the pumping force of the breech propellant charge combustion gases from a charged position to a discharged position while the slot is axial aligned with the reservoir open end of the second radial fluid passage and along a charge path motivated by fluid pressure of the liquid propellant charging the reservoir from the discharged position to the charged position, the charge path being angularly displaced from the discharge path such that the piston sleeve blocks the reservoir open end of the second radial fluid passage during liquid propellant charging of the reservoir, the booster stage further including camming elements interacting to angularly reposition the piston between the charge and discharge paths.

14. The gun defined in claim 13, wherein the camming elements include:

first and second pins mounted by the barrel, and first and second grooves formed in the sleeve, the first and second grooves extending in opposite axial directions from respective open ends to respective terminating cam surfaces, the first pin entering the open end of the first groove during initial piston movement along the discharge path from the charged position and engaging the cam surface of the first groove to angularly position the piston to the discharged position, the second pin entering the open end of the second groove during initial piston movement along the charge path from the discharge position and engaging the cam surface of the second groove to angularly position the piston to the charged position.

* * * * *